US005413020A

United States Patent [19]

Thompson

[11] Patent Number: 5,413,020

[45] Date of Patent: May 9, 1995

[54] RETRACTING GUITAR PICK HOLDER

[76] Inventor: Tok Thompson, P.O. Box 217, Kenai, Ak. 99611

[21] Appl. No.: 164,930

[22] Filed: Dec. 10, 1993

[51] Int. Cl.[6] ..... G10D 3/00

[52] U.S. Cl. ..... 84/329; 224/220; 224/267

[58] Field of Search ..... 84/329, 322, 453; 224/219, 220, 221, 267

[56] References Cited

U.S. PATENT DOCUMENTS

| | | | |
|---|---|---|---|
| 4,067,255 | 12/1976 | Camaioni | 84/329 |
| 4,467,693 | 8/1984 | Nasfell, Jr. | 84/329 |
| 4,489,867 | 12/1984 | Schwemberger | 224/219 |
| 4,982,641 | 1/1991 | Duhart | 84/329 |

*Primary Examiner*—M. L. Gellner
*Assistant Examiner*—Cassandra C. Spyrou

[57] ABSTRACT

A retracting guitar pick holder. Other patented designs of guitar pick holders are wholly different from mine, in that no designs besides mine hold a guitar pick in a readily available position. My pick holder consists of a wrist band (cloth, leather, or the like), onto which is fastened a tube, which extends to over the hand, and ends a little above the thumb and index finger, slightly in back of the tip of the thumb. The tube is hollow, and inside is an elastic cord which is fastened at the wrist end of the tube. At the fingers end, the cord is attached either to the pick, or to a clasp which is used to hold the pick.

4 Claims, 1 Drawing Sheet

FIGURE 1–A
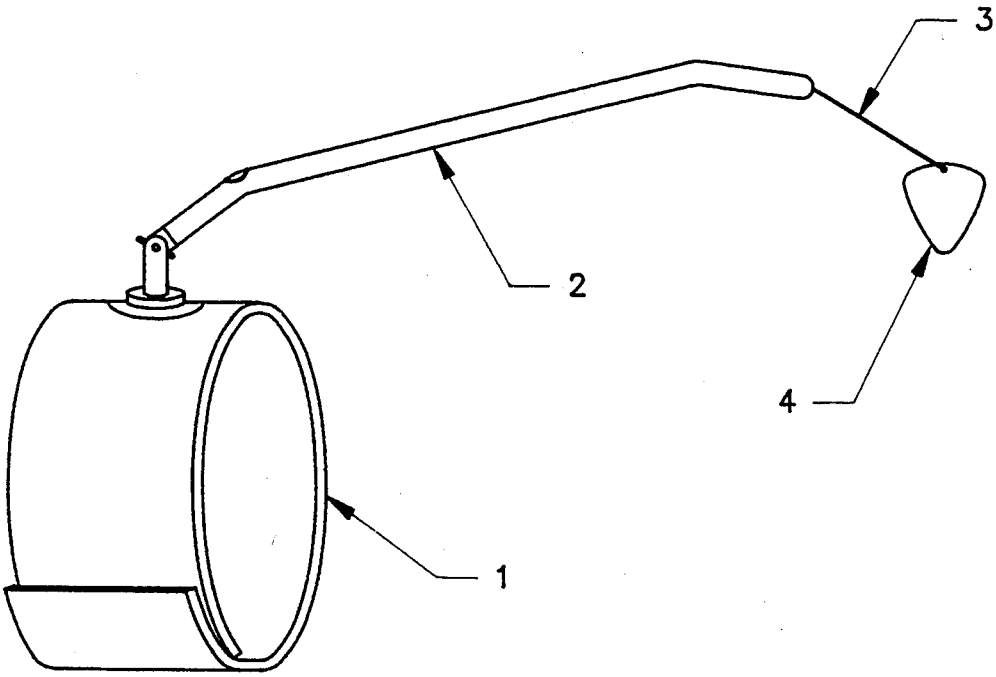
FIGURE 1–B
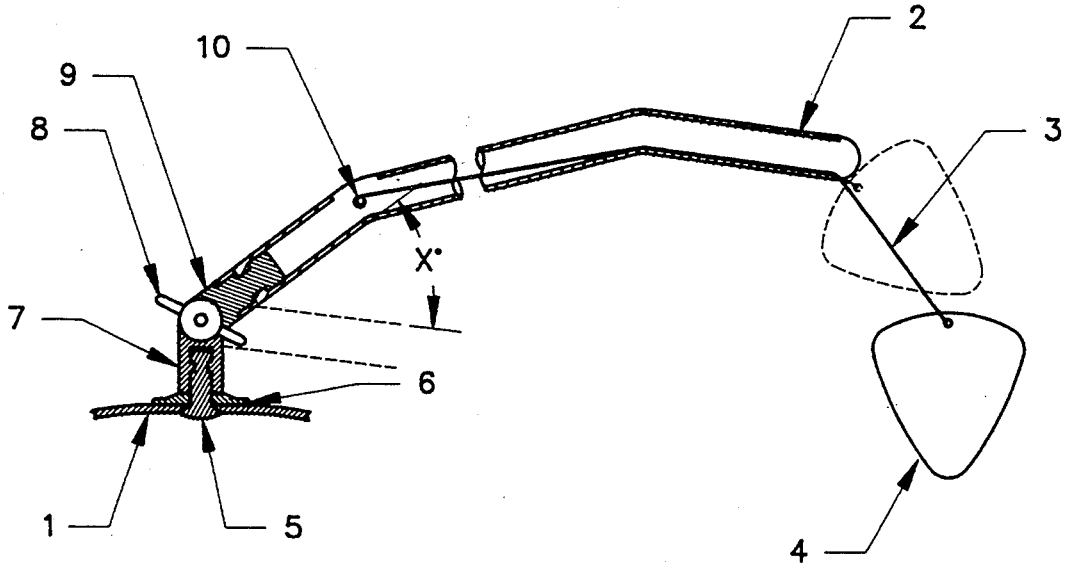

RETRACTING GUITAR PICK HOLDER

FIELD OF INVENTION

This design relates generally for a pick holder for playing a musical instrument, and, more particularly, to a mechanical device, fastened by means of a band onto the performer's wrist, which can hold a guitar pick in an easily graspable position, and allows for retaining of said pick when a guitarist is done with it.

DISCUSSION OF PRIOR ART

All previous guitar pick holders found in my search lack a means of retaining a pick when done with it, while at the same time keeping it in an available position for quick grasping and care-free use.

Only Ron Camaioni's (Dec. 6, 1976, #4,067,255) design allowed for a retracting action, but his design was based on mounting the device onto and inside of the guitar. Therefore, for each instrument a guitarist might wish to use a retracting pick, a separate device would have to be mounted inside the instrument. Also, when dealing with quality musical instruments, many musicians would dislike having to "operate" on them. Furthermore, the places on the guitar that Camaioni designated putting his device (the electronic adjustment area) are a four to five inch reach from the usual playing area of the hand, and thus involve a considerable amount of time and effort in reaching this area and grasping the pick, and then returning to the playing position (there is probably no better place to mount this on the guitar, since any protrusion could get in the way of the performer's hands). Also, having a cable stretch over this area could easily involve the cable inadvertantly touching the strings, producing sound where none was intended, or dampening the sound where there should be a holding note.

Most other relevant patents I found in my search were comprised of small cases, some of them spring-loaded, which would hold a plurality of picks inside, and which were designed to be fastened to either the guitar body, or a microphone stand.

Only Dean Duhart's design (Jan. 8, 1991, #4,982,641) was similar to mine in that the pick was, at least theoretically, retained on the performer. It was done so in his design by simply tethering it to an arm band, so that, when dropped, it would at least not drop to the floor. Problems inherent in this design would be that the pick and tether line might cause interference with the musician's playing while it was tethered, by bouncing into the hand or instrument, and also, that the pick would not be held in a convenient position for re-grasping at a later time.

I also searched for other arm-fastened holders, but the closest I found was an attachment for a grasping device onto a robot arm (#4,655,630), which could not be adapted for guitar pick use, and had no retractable qualities whatsoever.

OBJECTS AND ADVANTAGES

My design, on the other hand, accomplishes what no other guitar pick holder can do. With my retracting guitar pick holder, a guitar pick is held in a readily available position (requiring only an approximately two to three-inch wrist movement back and upwards), and, once discarded, springs back into the readily available position. There becomes no more need for dropping picks, and no need to reach far. Using this method, musicians would be able to switch from pick use to no pick use and back again with minimal effort and time delay (an important factor in musical performance tools). Using this design, no matter where on the instrument the performer is playing, the pick is always in the same nearby position relative to the grasping fingers. Also, as arm bands can be easily taken on and off, it can be used as desired, requiring no modification of the musical instrument. Also, it can be used interchangeably with any number of such stringed instruments.

Therefore, my retracting pick holder accomplishes what no other pick holder can do. Dean Duhart's design of a pick tethered to an arm clearly does not accomplish these objects, and Ron Camaioni's design, while allowing a retraction of the pick into a fixed position, cannot be used interchangeably with a multitude of instruments. Also, the ease with which my design can be used is much greater than Camaioni's, since the pick is always placed in a close fixed position to the fingers that would grasp it and use it to play, and not in some arbitrary place on the instrument itself.

Further objects and advantages of my invention will become apparent from a consideration of the drawings and ensuing descriptions of it.

BRIEF DESCRIPTION OF DRAWINGS

The accompanying drawings are composed of FIG. 1-A and FIG. 1-B. FIG. 1-A shows the external view of the design. FIG. 1-B shows the internal view of the design.

DETAILED DESCRIPTION OF INVENTION

The design calls for a wrist band 1, onto which is fastened a guide tube 2, by means of a base assembly 2A, B, 2C, 2D. In the guide tube 2 is a retracting line 3, tied on the wrist end to a bar 2F inside the guide tube 2, and on the hand end to a clasp, which grasps a pick, or tied to the pick itself 4. As the pick 4 is too big to go into the tube 2, the pick 4 is held at the tube's end, which is positioned over the hand, between the thumb and index finger, slightly behind the end of the thumb. The wrist 1 band can consist of leather, cloth, metal, or any other material suitable for a snug fitting, preferably adjustable band around the wrist. A small hole is in the band 1, and through this passes a bolt 2A, with a washer 2B on the outer side. This bolt 2A fastens into the base tube 2C. The base tube 2C is bolted to the main tube 2 with a bolt and wing nut assembly generally indicated in FIG. 1-B at 2D. The base tube 2C has a receptacle for the above-mentioned bolt 2A, and is attached to the main tube 2 by placing the main tube's flattened lower end through the slot on the top of the base tube 2C. The flattened lower end of the main tube 2 has an aperture in it, and a second bolt at 2D passes through the base tube's bolt hole at 2D and the main tube's (2) flattened end's aperture at 2D. This connection is tightened or loosened (for personal adjustments of the angle) by adjusting the wing nut at 2D.

Other ways of attaching the tube 2 to the arm band 1 are also conceivable, such as a different mechanical holding device, direct gluing, or gluing combined with leather stitching, etc.

The main tube 2, which may have a telescoping section 2E similar to those found in antennaes, extends in length to partially over the hand. Inside the tube is an elastic cord 3, which is attached (tied) to a bar 2F inside the tube 2 near the base. An access hole in the tube can be seen in the diagram. On the other end, the cord 3 is fastened either directly to a guitar pick 4, or to a clasp, which could then can be fastened to the guitar pick 4.

Of course, to fulfill the function of the design, any means that attaches the line 3 to the pick 4 would do. Similarly, since the point of the line 3 is to be retracting, this could also be accomplished by other embodiments wherein an extension spring fastened to the line and the bottom of the tube is so utilized, or similar mechanical retracting device. The tube does not need in all embodiments to be telescoping, but this allows for extra personal adjustments.

OPERATION OF INVENTION

The manner of using the retracting guitar pick holder is straightforward. Firstly, the band is secured around the wrist, and the rod adjusted to end slightly above the hand when the hand is held straight out, and a little in back of the end of the thumb, between the thumb and index finger. Since the retractive line pulls the pick into a steady position against the end of the tube, all that is required to operate the device is an upwards wrist motion to put the pick in a direct line Tok between the index finger and thumb, a grasping motion with the thumb and index finger to grasp the pick, and from then on the musician is free to use the pick on the instrument. When done, the musician can simply release the pick, and since the pick is bigger than the aperture at the end of the tube, it will be pulled back into its original position.

The clasp can be opened to release a pick, and another pick put in its place.

In the preferred embodiment, the elastic band could be replaced by re-tying the band to the bar at the wrist end of the tube by means of the access hole, and to the clasp at the hand end. In the embodiment with a spring and non-elastic cord, the string could be replaced in the same way.

SUMMARY, RAMIFICATIONS, AND SCOPE

Accordingly, the reader will see that the retracting pick holder can be used to retain a pick in a convenient position. With this design, there is no need to worry about dropping and losing the pick. Also, there is no need to modify a musical instrument for this purpose. My retracting pick holder will hold the pick only inches away from the grasping fingers, conveniently out of the way of playing the instrument. Because my design accomplishes these highly desirable functions, it could enable guitarists or other pick-using musicians to have much greater flexibility in their use of picks. Conceivably, other tools could also use this same retracting clasp design, where the demand of high speed availability and reliability are also important.

Although the description above contain many specifities, these should not be construed as limiting the scope of the invention but as merely providing illustrations of some of the presently preferred embodiments of this invention. For example, the base may have other shapes, the guide tube may be comprised of a rod with guide lines for the line, etc. Thus, the scope of the invention should be determined by the appended claims and their legal equivalents, rather than by the examples given.

I claim:

1. A retracting guitar pick holder, comprising:

a) a band of material for fastening around a wrist or lower arm of a user;

b) a tube having a first end and a second end and further dimensioned to extend over a hand of the user;

c) means for joining said first end of said tube and said band;

d) a retracting line having a first and second end; the retracted line positioned within said tube; said first end of said line attached approximate the first end of the tube;

e) clasp means for attaching said second end of the line to a pick.

2. The retracting guitar pick holder of claim 1 wherein: the tube includes a telesopic portion.

3. The retracting guitar pick holder of claim 1 wherein: said joining means includes means for pivotally and rotatably adjusting the orientation of the tube relative to the band.

4. The retracting guitar pick holder of claim 1 wherein: said line being an elastic cord.

* * * * *